US006986470B2

(12) United States Patent
Osler

(10) Patent No.: US 6,986,470 B2
(45) Date of Patent: Jan. 17, 2006

(54) RAIL MOUNT

(75) Inventor: Wilbur F. Osler, Mattituck, NY (US)

(73) Assignee: Advanced Track Products, LLC, Mattituck, NY (US)

( * ) Notice: Subject to any disclaimer, the term of this patent is extended or adjusted under 35 U.S.C. 154(b) by 99 days.

(21) Appl. No.: 10/691,454

(22) Filed: Oct. 22, 2003

(65) Prior Publication Data

US 2005/0045059 A1 Mar. 3, 2005

Related U.S. Application Data

(60) Provisional application No. 60/420,588, filed on Oct. 23, 2002.

(51) Int. Cl.
*E01B 9/38* (2006.01)

(52) U.S. Cl. ..... 238/264; 238/283

(58) Field of Classification Search ..... 238/264, 238/288, 283, 287, 306, 310, 323, 338, 361, 238/382, 307; 246/467, 453; 105/199.3
See application file for complete search history.

(56) References Cited

U.S. PATENT DOCUMENTS

| | | | | | |
|---|---|---|---|---|---|
| 2,146,341 | A | * | 2/1939 | Kahn | 238/283 |
| 4,915,298 | A | * | 4/1990 | Ortwein | 238/283 |
| 5,203,501 | A | * | 4/1993 | Vanotti | 238/265 |
| 6,789,740 | B2 | * | 9/2004 | Osler | 238/264 |

* cited by examiner

*Primary Examiner*—Frantz F. Jules
(74) *Attorney, Agent, or Firm*—Herbert Dubno

(57) ABSTRACT

A track fastener has a top plate spacedly surrounded by a frame and connected to the frame by a body of elastomer bonded to both the top plate and the frame at all surfaces at which the elastomer fills the gap between the two. The frame has hoods overhanging ribs of the elastomer which have inclined flanks covered by the elastomer as the elastomer reaches down from the gap between the hood and the rib to the top surface of the top plate lying below the receiving surface of the top plate on which the rail bears.

12 Claims, 7 Drawing Sheets

RAIL MOUNT

CROSS REFERENCE TO RELATED APPLICATION

This application is related to the provisional application No. 60/420,588 filed 23 Oct. 2002 and claims the benefit thereof under 35 USC 120.

FIELD OF THE INVENTION

The present application relates to a rail mount having a compression base plate and, more particularly, to an improved rail mount assembly in which the base plate is an elastomeric body bonded to a frame and to a top plate carrying the rail.

BACKGROUND OF THE INVENTION

In earlier configurations of rail mounting assemblies having an elastomeric body under compression, a metal frame and a top plate, there have been problems in the development of stress and strain in the elastomer which have resulted in tearing or separation of the elastomer and reduced life.

OBJECTS OF THE INVENTION

It is the principal object of the present invention to provide an improved rail mount with increased life and enhanced performance.

Another object of the invention is to provide a track fastener which can be accommodated to various load requirements and is more versatile and effective than earlier track fasteners.

SUMMARY OF THE INVENTION

These objects are achieved, in accordance with the invention in a track fastener which comprises:

a generally rectangular top plate formed with a central rail receiving surface on a top of the top plate flanked at opposite ends of the receiving surface by eyes adapted to receive e-clips for securing a rail to the rail mount on the receiving surface, the top plate having a planar bottom surface, the receiving surface being canted with respect to a plane of the bottom surface, the top plate having upwardly extending ribs over a full width of the top plate at opposite ends thereof, each rib having an outer flank perpendicular to the plane, an inner flank inclined at an angle of substantially 30° to 60° to a vertical, and a rounded junction between the flanks;

a frame having a rectangular opening receiving the top plate with all-around clearance, the frame having a bottom surface spaced below the bottom surface of the plate and defining a cavity underlying the plate and communicating with the all-around clearance, the frame being further formed with hoods at opposite ends thereof reaching inwardly over the ribs and spaced above the ribs, and with four outwardly extending lugs located respectively along opposite longitudinal sides of the frame at each end thereof, the lugs being formed with openings enabling the passage of anchor bolts for securing the rail mount to a support; and a body of elastomer bonded to both the top plate and the frame at all surfaces of the top plate and the frame contacted by the body of elastomer, the body of elastomer filling the cavity and the clearance and having a bottom formed with spaced apart pads of the elastomer and bearing load against the support varying as a train rides over the rail, the elastomer filling gaps between the hoods and the ribs and extending downwardly along the inner flanks. The inner flank angle may be 45°±7° in a preferred embodiment of the invention.

According to a feature of the invention, the pads are elongated in a direction perpendicular to a longitudinal axis of the rail mount, are of generally oval configuration and are arranged in a plurality of rows, preferably two, parallel to this axis. In particular, each of the pads may extend over at least ⅓ of the width of the body of elastomer which forms the bottom of the body and is juxtaposed with the support surface.

The elastomer is selected from the group which consists of natural rubber, synthetic rubber, mixtures of natural and synthetic rubber and silicone rubber and synthetic resins.

It has been found to be of considerable advantage for the hoods to have curved inner surfaces juxtaposed with the ribs but with radii of curvature of at least 5 mm. In earlier systems in which hoods were provided above a top plate, they had substantially smaller internal radii of curvature.

The elastomer on the inner flanks should taper in thickness downwardly to the top surface of the top plate and should have an outer concave face. The elastomer should also reach over the upper surface of the hood down to a ledge of the frame.

Each of the inner flanks also terminates at the top surface of the top plate and the receiving surface should have its lowest point above the top surface. The receiving surface should have a cant or tilt to the horizontal of a ratio of about 1:20.

The system of the invention has a number of significant advantages over earlier track fastener designs. Firstly, the track fastener of the invention can have vertical and/or lateral stiffness which can be tuned to the various requirements of the track fastener since the pads engage the support surface below the track fastener at different times during deflection caused by the passage of a train. As the track fastener senses increased axial loads from a passing train there is a corresponding increase in deflection of the elastomer body which causes a greater number of the pads to become supporting and as the number of pads which become supporting increases and the pads come under compression, the stiffness increases. The track fastener is thus particularly beneficial for tracks serving mixed axle loads, e.g. vehicles which are fully located or unloaded and commuter or freight or return traffic.

The track fastener of the invention also is effective in case of deterioration of the elastomer bond since the frame safely restrains lateral, longitudinal and uplift movements of the top plate.

The fact that four anchor bolts are used likewise provides excellent security and distribution of hold down forces.

All of the forces and vibrations reaching the frame are buffered by the elastomer body and anchor bolt failure is reduced. Since the receiving surface is located above the top plane or surface of the top plate, the rail cannot contact or abrade the top surface of the elastomer.

The system can allow vertical and lateral stiffness characteristics to be changed at a minimum cost by simply altering the characteristics of the elastomer.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
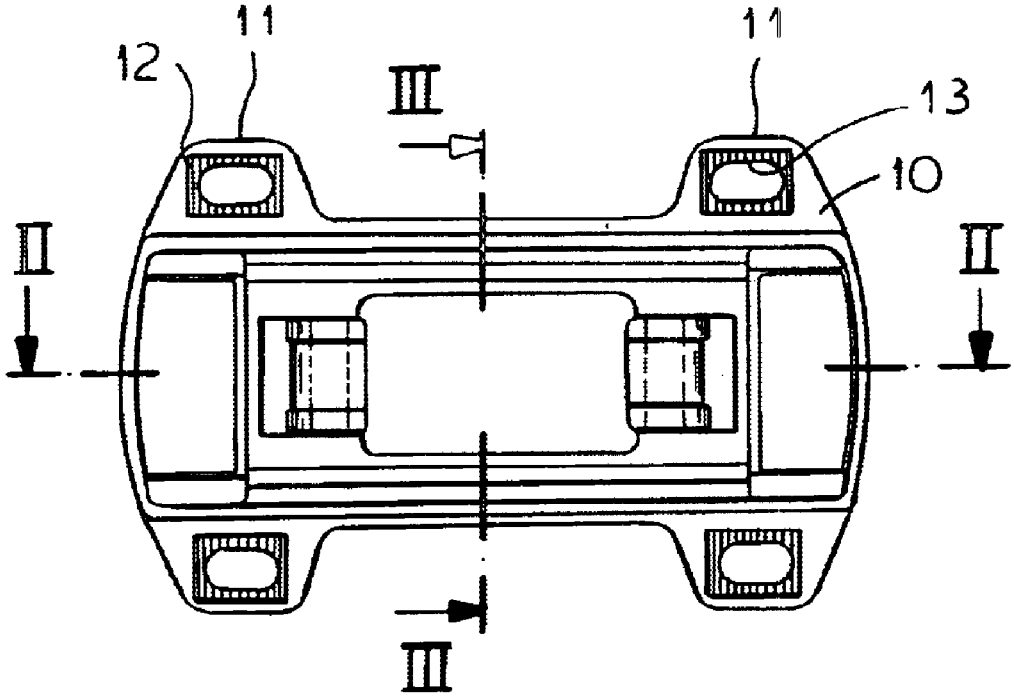
FIG. 1 is a plan view of the assembly.
Figure 2:
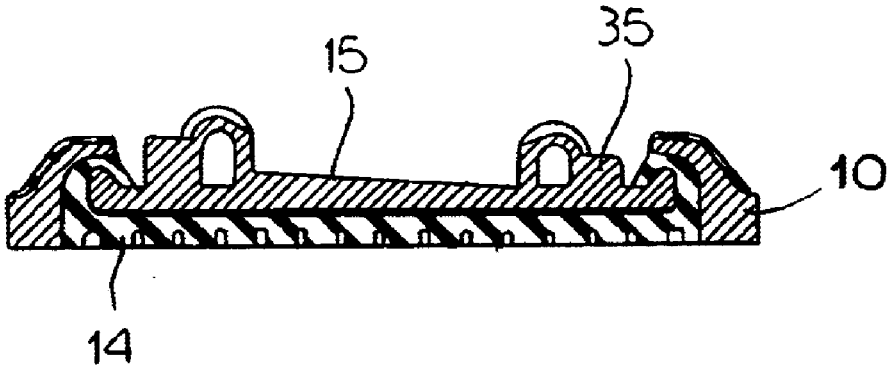
FIG. 2 is a section taken along the line II—II of FIG. 1
Figure 13:
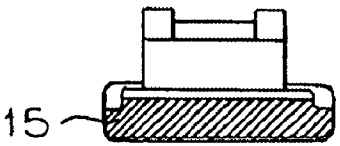
FIG. 13 is a section along the line XIII—XIII of FIG. 10.
Figure 14:
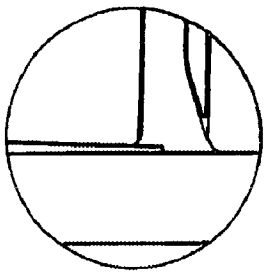
FIG. 14 is a detail XIV of FIG. 11.
Figure 5:
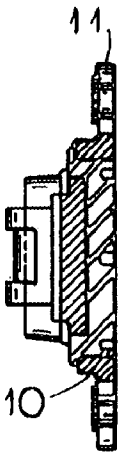
FIG. 5 is a section taken along the line V—V of FIG. 4.
Figure 3:
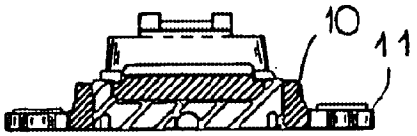
FIG. 3 is a section taken along the line III—III of FIG. 1.
Figure 4:
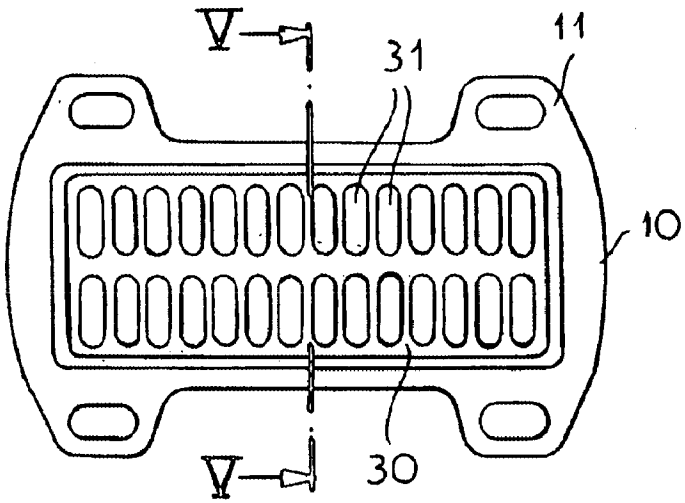
FIG. 4 is a bottom plan view of the assembly.
Figure 9:
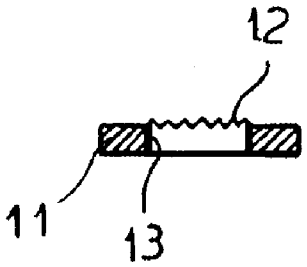
FIG. 9 is a section along the line IX—IX of FIG. 6.

As can be seen from FIGS. 1–5, the compression base plate assembly comprises an outer frame 10 having outwardly extending lugs 11 through which bolts can pass and which has a toothed portion 12 surrounding the slot 13 through which the bolt passes. The toothed portion is shown in section in FIG. 9.

The frame receives a body 1 of an elastomer (e.g. rubber neoprene) which is bonded (e.g. vulcanized) to the frame 10 and to the top plate 15.

Figure 6:
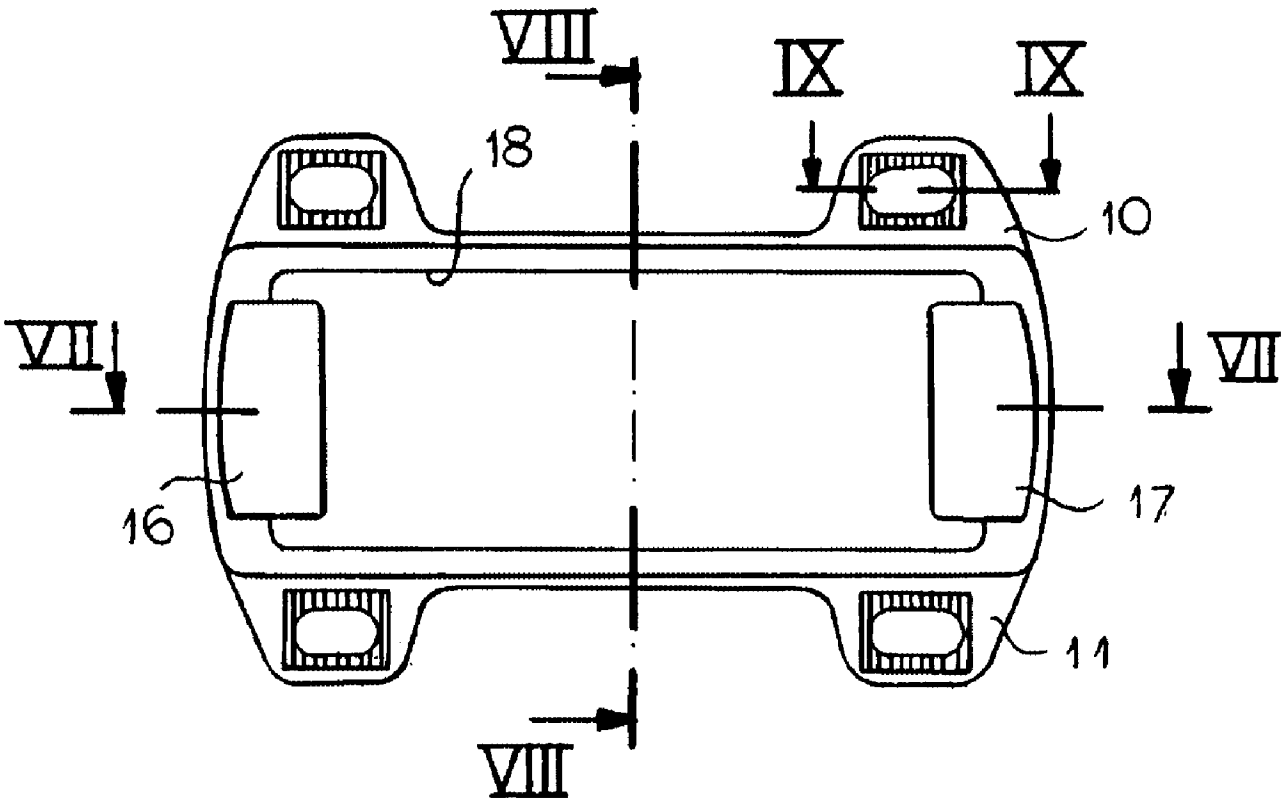
FIG. 6 is a top plan view of the frame member.
Figure 8:
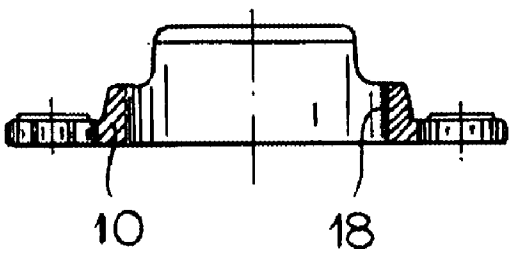
FIG. 8. is a section along the line VIII—VIII of FIG. 6.
Figure 7:
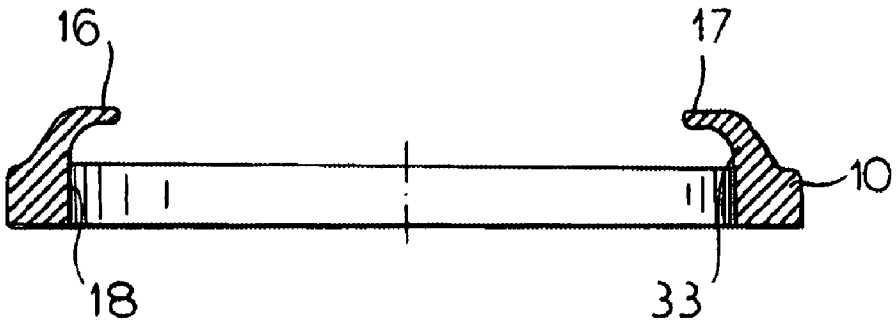
FIG. 7 is a section along the line VII—VII of FIG. 6.
Figure 10:
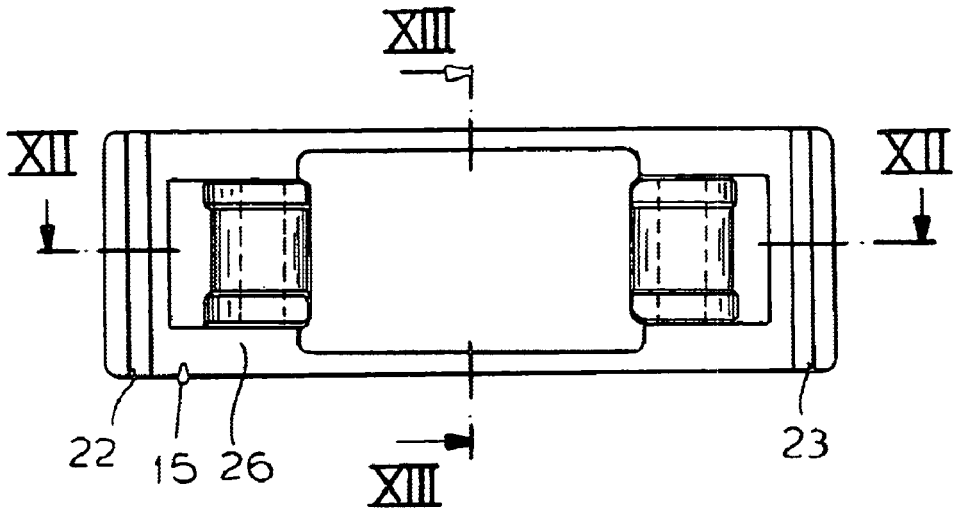
FIG. 10 is a plan view of the top plate.
Figure 11:
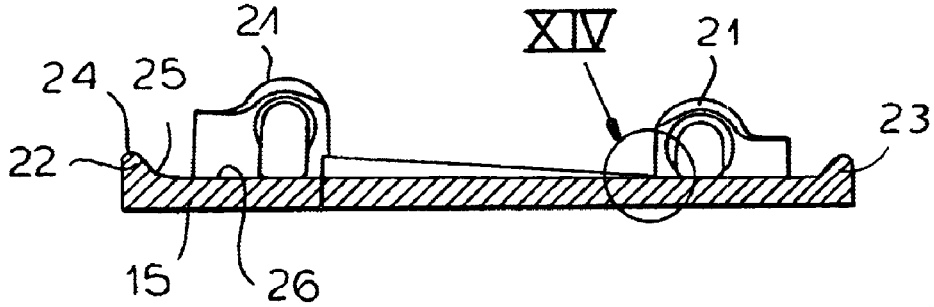
FIG. 11 is a side elevational view of the top plate.
Figure 12:
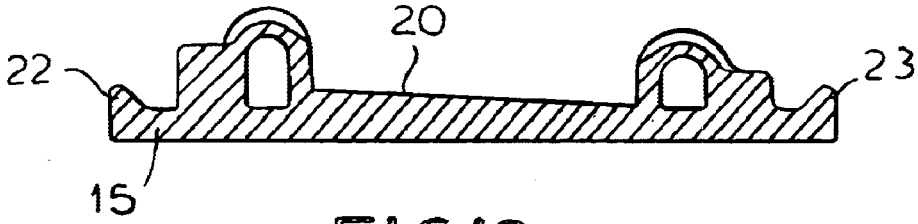
FIG. 12 is a section along the line XII—XII of FIG. 10.

The frame 10 (see especially FIGS. 6–9), has a pair of hoods 16 and 17 overhanging an opening 18 in the frame. The opening 18 is rectangular as can be seen from FIG. 6.

Figure 15:
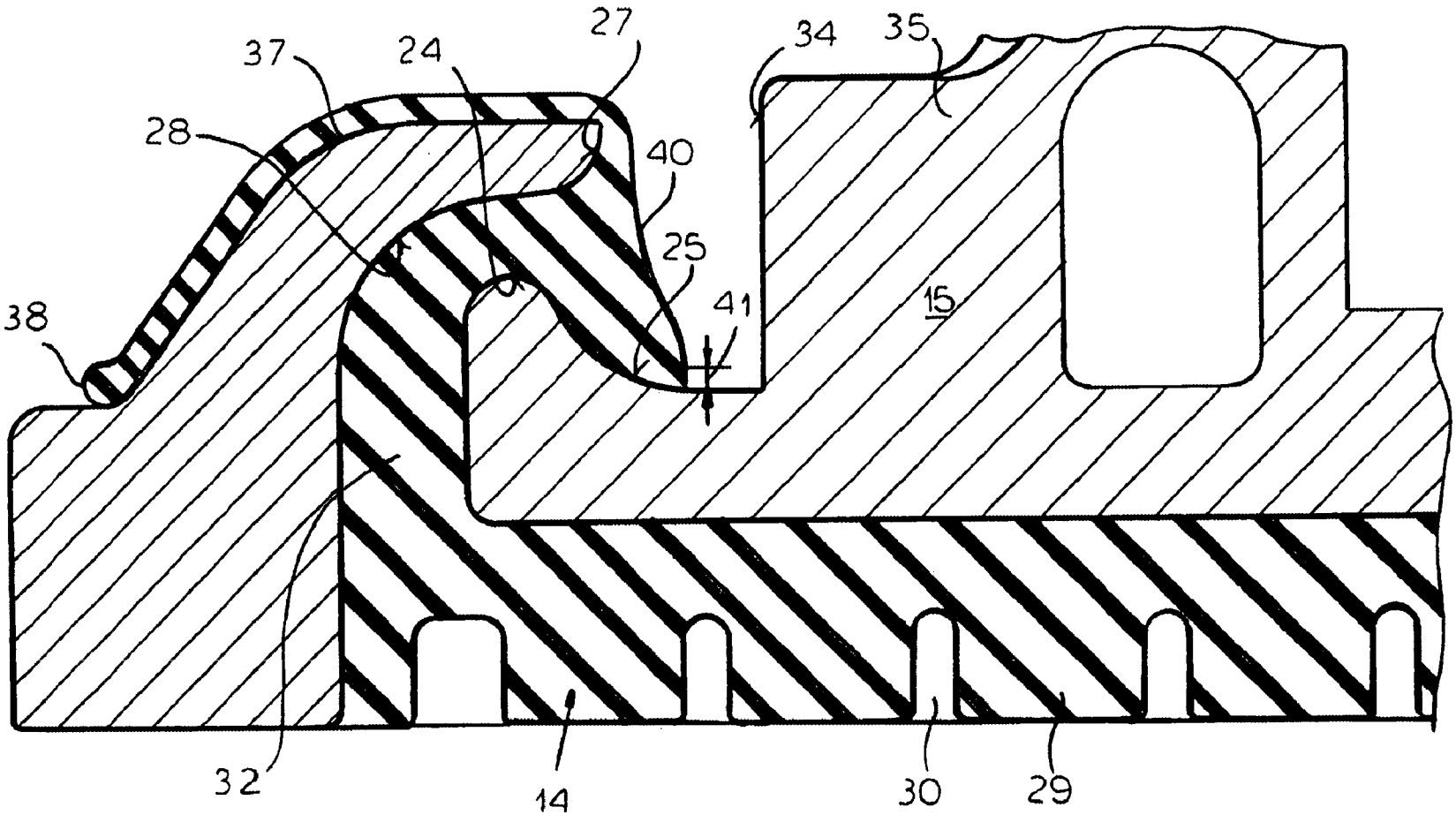
FIG. 15 is an enlarged cross sectional view of a portion of the assembly.

The top plate 15 can have an inclined platform 20 upon which the base of a rail can rest and tubular bosses or bushes 21 flanking the platform to receive fastening elements for securing the rail in place. The top plate 15 is of rectangular configuration and has ridges 22 and 23 at its ends, adapted to lie below the inner extremities of the hoods 16 and 17 (see especially FIGS. 2 and 5). The ribs 22 and 23 are radiused along their tops 24 and bases 25 where the ribs merge into the upper surface 26 of the top plate which is generally planar. The hoods 16 and 17 have radiused edges 27 and radiused inner faces 28 as can be seen from FIG. 15.

The elastomeric body 14 forms a base plate 29 having grooves 30 (FIG. 15) separating islands 31 with which the base plate rests upon a support surface. In addition, the body 14 comprises elastomeric framing parts 32 integral with the elastomeric base plate and rising along the edges of the top plate 15 (see especially FIGS. 2 and 15) and along the inner wall 33 defining the opening 18 in the frame 10.

The frame portions 32 of the elastomer passes over the ridges 24 into the arcuate portion 25 and terminates just short of a vertical wall 34 of the central portion 35 of the top plate. The elastomeric material also overhangs the hood 16 or 17, reaching outwardly over the outer surface 37 thereof to terminate at 38 at a ledge of the frame just short of the outer periphery of the frame. As noted, the elastomeric material is vulcanized or bonded to both the top plate 15 and the frame 10 at the surfaces at which the elastomer is in contact with them. The surface 40 of the elastomer between the hood and the bottom 41 of the channel between the rib 22 and 23 and the central portion 35 is of a concave and inclined contour. With this configuration of the elastomer and the rib and hood parts as described, stress and strain in the elastomer with cyclically reversing loads is effectively countered to prevent damage to the elastomer. The underside hood radius of the invention has been increased significantly over that commonly provided (up to 5 mm), resulting in a reduction of bond stress. The downward and inward inclination of the elastomer at the upper surface of the top plate likewise enables the mount to better survive cyclic oscillating loads reversing from tension to compression.

Figure 16:
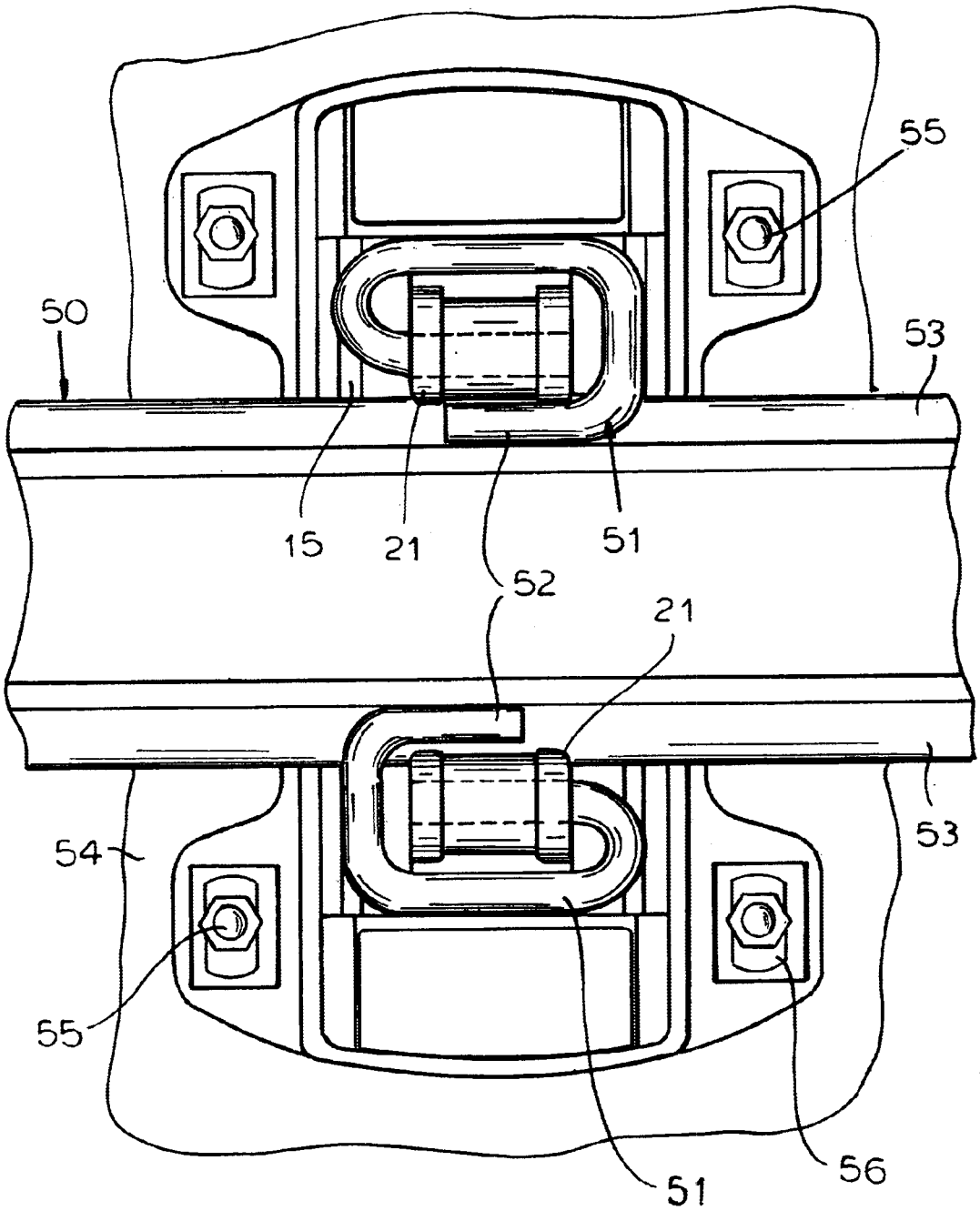
FIG. 16 is a plan view of the track fastener showing a rail attached to the track.

In FIG. 16, a rail 50 is shown to be secured to the top plate 15 by e-clips 51 engaged in the tubular bosses 21 and having ends 52 bearing on the flanges 53 of the rail. The e-clips can be welded to the rail.

The track fastener is shown in FIG. 16 to be held onto the support surface 54 by bolts 55 having oval washers 56 bearing upon the serrated margins 12 surrounding the slots 13 through which the respective bolts pass.

I claim:

1. A rail mount comprising:

a generally rectangular top plate formed with a central rail receiving surface on a top of said top plate flanked at opposite ends of said receiving surface by eyes adapted to receive e-clips for securing a rail to the rail mount on said receiving surface, said top plate having a planar bottom surface, said receiving surface being canted with respect to a plane of said bottom surface, said top plate having upwardly extending ribs over a full width of the top plate at opposite ends thereof, each rib having an outer flank perpendicular to said plane, an inner flank inclined at an angle of substantially 30° to 60° to a vertical, and a rounded junction between said flanks;

a frame having a rectangular opening receiving said top plate with all-around clearance, said frame having a bottom surface spaced below said bottom surface of said plate and defining a cavity underlying said plate and communicating with said all-around clearance, said frame being further formed with hoods at opposite ends thereof reaching inwardly over said ribs and spaced above said ribs, and with four outwardly extending lugs located respectively along opposite longitudinal sides of said frame at each end thereof, said lugs being formed with openings enabling the passage of anchor bolts for securing the rail mount to a support; and a body of elastomer bonded to both said top plate and said frame at all surfaces of said top plate and said frame contacted by said body of elastomer, said body of elastomer filling said cavity and said clearance and having a bottom formed with spaced apart pads of said elastomer and bearing load against said support varying as a train rides over said rail, said elastomer filling gaps between said hoods and said ribs and extending downwardly along said inner flanks.

2. The rail mount defined in claim 1 wherein said pads are elongated in a direction perpendicular to a longitudinal axis of the rail mount, are of generally oval configuration and are arranged in a plurality of rows parallel to said axis.

3. The rail mount defined in claim 2 wherein the elastomer is selected from the group which consists of natural rubber, synthetic rubber, a mixture of natural rubber and synthetic rubber, silicone rubber and a synthetic resin.

4. The rail mount defined in claim 3 wherein said hoods have curved inner surfaces juxtaposed with said ribs and of radii of curvature of at least 5 mm.

5. The rail mount defined in claim 4 wherein the elastomer on said inner flanks tapers in thickness downwardly and has an outer concave face.

6. The rail mount defined in claim 5 wherein each of said inner flanks terminates at a top surface of the top plate, said receiving surface lying above said top surface.

7. The rail mount defined in claim 6 wherein said receiving surface has a cant to the horizontal of a ratio of about 1:20.

8. The rail mount defined in claim 1 wherein the elastomer is selected from the group which consists of natural rubber, synthetic rubber, a mixture of natural rubber and synthetic rubber, silicone rubber and a synthetic resin.

9. The rail mount defined in claim 1 wherein said hoods have curved inner surfaces juxtaposed with said ribs and of radii of curvature of at least 5 mm.

10. The rail mount defined in claim 1 wherein the elastomer on said inner flanks tapers in thickness downwardly and has an outer concave face on each of said inner flanks.

11. The rail mount defined in claim 1 wherein each of said inner flanks terminates at a top surface of the top plate, said receiving surface lying above said top surface.

12. The rail mount defined in claim 1 wherein said receiving surface has a cant to the horizontal of a ratio of about 1:20.

* * * * *